US005904053A

United States Patent [19]

Polk et al.

[11] Patent Number: 5,904,053

[45] Date of Patent: May 18, 1999

[54] DRAINAGE MANAGEMENT SYSTEM FOR REFRIGERATION COIL

[75] Inventors: Gregory A. Polk, Franklin; Andy L. Derryberry, Nashville; Steve Brady, Ashland City; Cos Caronna, Murfreesboro; Timothy P. O'Leary, Antioch; Clarence D. Cash, Fayetteville; Louis R. Goodman, Nashville; Charles E. Brown, Jr., MT Pleasant, all of Tenn.

[73] Assignee: International Comfort Products, Nashville, Tenn.

[21] Appl. No.: 08/988,106

[22] Filed: Dec. 10, 1997

Related U.S. Application Data

[60] Provisional application No. 60/032,812, Dec. 11, 1996.

[51] Int. Cl.[6] ..... F25D 21/14

[52] U.S. Cl. ..... 62/285; 62/286

[58] Field of Search ..... 62/272, 285, 286, 62/288, 291

[56] References Cited

U.S. PATENT DOCUMENTS

| | | | |
|---|---|---|---|
| 3,097,507 | 7/1963 | Makuh | 62/285 |
| 3,303,666 | 2/1967 | Toper | 62/426 |
| 3,404,540 | 10/1968 | Bryans et al. | 62/285 |
| 3,596,475 | 8/1971 | Berger | 62/285 |
| 3,910,061 | 10/1975 | Irwin | 62/290 |
| 4,000,779 | 1/1977 | Irwin | 165/111 |
| 4,416,327 | 11/1983 | Nakada et al. | 165/122 |
| 4,474,232 | 10/1984 | Wright et al. | 165/137 |
| 4,633,673 | 1/1987 | Morrison et al. | 62/129 |
| 4,679,405 | 7/1987 | Mitchell et al. | 62/285 |
| 5,071,027 | 12/1991 | Sullivan | 220/571 |
| 5,207,074 | 5/1993 | Cox et al. | 62/285 |
| 5,341,870 | 8/1994 | Hughes et al. | 165/110 |
| 5,511,386 | 4/1996 | Russ et al. | 62/285 |
| 5,664,431 | 9/1997 | Martin | 62/286 |
| 5,669,230 | 9/1997 | Bruce et al. | 62/285 |

*Primary Examiner*—William Doerrler
*Attorney, Agent, or Firm*—Baker & Daniels

[57] ABSTRACT

A refrigeration system includes an evaporator coil with a drain pan having alternative drain openings which receive movable primary and secondary drain plugs. A drain pan for use with horizontal A-coils is provided with alternative drain pan openings permitting a variety of configurations whereby the evaporator coil may be oriented in the space conditioning system in the most effective manner depending upon on-site conditions. A combination horizontal coil support and drainage duct with coil baffle provides a channel for effective communication of drainage fluid from the coil to the drain pan.

21 Claims, 9 Drawing Sheets

DRAINAGE MANAGEMENT SYSTEM FOR REFRIGERATION COIL

This application claims benefit of Provisional Application Ser. No. 60/032,812 filed Dec. 11, 1996.

BACKGROUND OF THE INVENTION

This invention relates to air-conditioning or refrigeration systems and more particularly to drainage systems for use with evaporator coils and support structure incorporated in space conditioning systems.

Conventional refrigeration systems employ a motor driven compressor, an evaporator for absorbing heat from a load, an expansion device for controlling flow of refrigerant into the evaporator, and a condenser for discharging heat from the system. A flow control device, comprising either a fixed capillary or orifice or a controllable expansion valve, varies the flow of refrigerant. Thus liquid refrigerant is admitted into the evaporator so that the heat absorbed from the load will warm the liquid refrigerant and evaporate the refrigerant.

Refrigeration systems are conventionally used with air conditioning systems which may be subject to variable conditions. For instance, the desired temperature of the space to be controlled may be selected to be higher or lower, the outdoor ambient temperature may vary, and thus the cooling load of the space to be controlled may vary depending upon variations of the building loads. Thus the loading of an air conditioning system can vary greatly.

During refrigeration operation, the evaporator coil will remove moisture from the air being conditioned as it passes thereover. A drainage pan and conduit system are provided to collect the condensate and remove the fluid from the system to a drainage system or other condensate receiving system. Generally at least one drain opening is provided in the drain pan and is connected to a conduit. Overflow and spillage occurs when the drain opening becomes clogged or otherwise obstructed. Often when the drain opening becomes partially obstructed drainage will settle and stand in the drain pan.

SUMMARY OF THE INVENTION

The present invention overcomes the disadvantages of the above described prior art refrigeration systems by providing an improved drainage management system therefor that more efficiently and effectively 1) collects and channels the condensate from the coil to the drain pan, 2) drains the condensate from the drain pan to the drain opening, 3) provides an improved support structure for horizontal A-coils, and 4) provides alternative configurations of the drain pan, drain plugs, and coil, resulting in a more versatile assembly which can be optimally configured to overcome on-site physical constraints.

The typical refrigeration system incorporating the drainage management system of the present invention includes a compressor, a condenser coil, and an evaporator coil with a suction line and liquid line connected therebetween. The evaporator as a result of its operation collects water on its outer surface, and the present invention facilitates the removal of the condensate from the evaporator to improve the heat exchange efficiency of the coil.

I. MOVABLE SECONDARY DRAIN PLUG AND DRAIN PAN WITH MULTIPLE ALTERNATIVE DRAIN OPENINGS

The improved drainage management system of the present invention provides a drain pan with alternative drain openings for receiving movable secondary drain plugs. In one embodiment, the movable secondary drain plugs are to be used with cased coils such as evaporator coils for air conditioning systems and the like which have their own housings. These coils are typically installed in a duct system wherein the coil casing serves as part of the duct system. Condensate which is formed on the coil is deposited to a drain pan. The drain pan includes primary drain holes, e.g. three, which are connected to a pipe to allow the condensate to drain from the drain pan. These pans also include secondary drain holes which are intended to serve as an over-flow if the primary drain hole becomes plugged. It is desirable to locate the secondary drain holes in an area where the homeowner can detect whether the secondary drain holes are draining condensate. If condensate is being drained through the secondary drain plug, then the homeowner is alerted to the fact that the primary drain hole is plugged. The present invention provides an arrangement whereby the secondary drain plugs can be inserted in various locations in the drain pan so the selected location can have the best visibility.

Normally the drain pan includes a primary drain pan opening, which is connected to the primary drain pipe. A secondary drain opening is typically located above the primary drain opening and therefore cannot be used alternatively as the primary drain opening.

The secondary plug of the present invention, which is best shown in FIG. 5, consists of two sections. One section is simply a connecting section to connect to tubing. The other section is a threaded part which threads into a drain pan hole. Between those two sections is a wall with a small central hole in it. The small central hole ensures that the secondary drain connection will only conduct condensate when the condensate reaches a particular level in the drain pan which is higher than the level at which the condensate flows out of the primary drain opening.

The multiple openings provided in the drain pan are positioned equally on the horizontal plane to permit equally effective drainage regardless of the drainage opening selected. The openings may be connected to either the primary drainage piping or the secondary drainage piping. By locating the openings on opposite sides of the drain pan, the unit may be piped so as to provide the greatest access to the end user. Also, this arrangement provides greater versatility for the field installation personnel, allowing for the drain pan to be placed in a variety of orientations. The drainage plug effects the conversion of a conventional primary drainage opening into a secondary opening.

II. DRAIN PAN FOR HORIZONTAL A-COIL ARRANGEMENTS HAVING MULTIPLE ALTERNATIVE DRAIN OPENINGS

The improved drainage management system of the present invention provides a drainage pan for use in horizontal A-coil applications. The base of the pan is sloped so that liquids collected therein drain toward the two pairs of drainage openings located on opposite sides of the pan. The openings are on an equal horizontal plane for equivalent draining efficiency. Any combination of the openings may be connected to the primary and secondary drainage piping, depending upon accessibility. The horizontal drain pan is provided with a coil support channel for receiving an end of the frame surrounding the A-coil. The pan permits either horizontal left or horizontal right arrangements.

III. COMBINATION COIL SUPPORT AND DRAINAGE DUCT WITH COIL BAFFLE FOR HORIZONTAL A-COIL APPLICATIONS

The improved drainage management system of the present invention provides two coil supports, as illustrated in FIG. 1, which are positioned at opposite ends of an A-coil at points distal the coil frame with the coil placed in the horizontal position. Each support is provided with a drainage channel. The baffle plate illustrated in FIGS. 10 or 11 is positioned along the top of the A-coil and has a V-shaped cross-section. In one embodiment, U-shaped channels extend lengthwise along opposite sides of the baffle plate to collect drainage liquid condensed on the A-coil. During compressor operation, liquid condenses on the structure of the A-coil. A problem with prior art arrangements is that the liquid would drip from the coil into the middle of the drain pan. The on-rushing air would pick up much of the moisture and carry it off into the HVAC ductwork, referred to as "blow-off," before the moisture can be collected and carried off via the drainage system. This problem is alleviated with the baffle and coil support arrangement of the present invention.

With the baffle plate and the supports in place, the condensed liquid collects in the U-shaped channel of the baffle plate and is carried off to the sides of the A-coil and away from the middle of the drain pan. The support channels are in fluid communication with the baffle U-shaped channels. The collected fluid is communicated into the support channels, which act like a downspout, and into the drain pan along either side of the A-coil.

BRIEF DESCRIPTION OF THE DRAWINGS

The above mentioned and other features and objects of the invention, and the manner of attaining them, will become more apparent and the invention itself will be better understood by reference to the following description of an embodiment of the invention taken in conjunction with the accompanying drawings, wherein.

Figure 1:
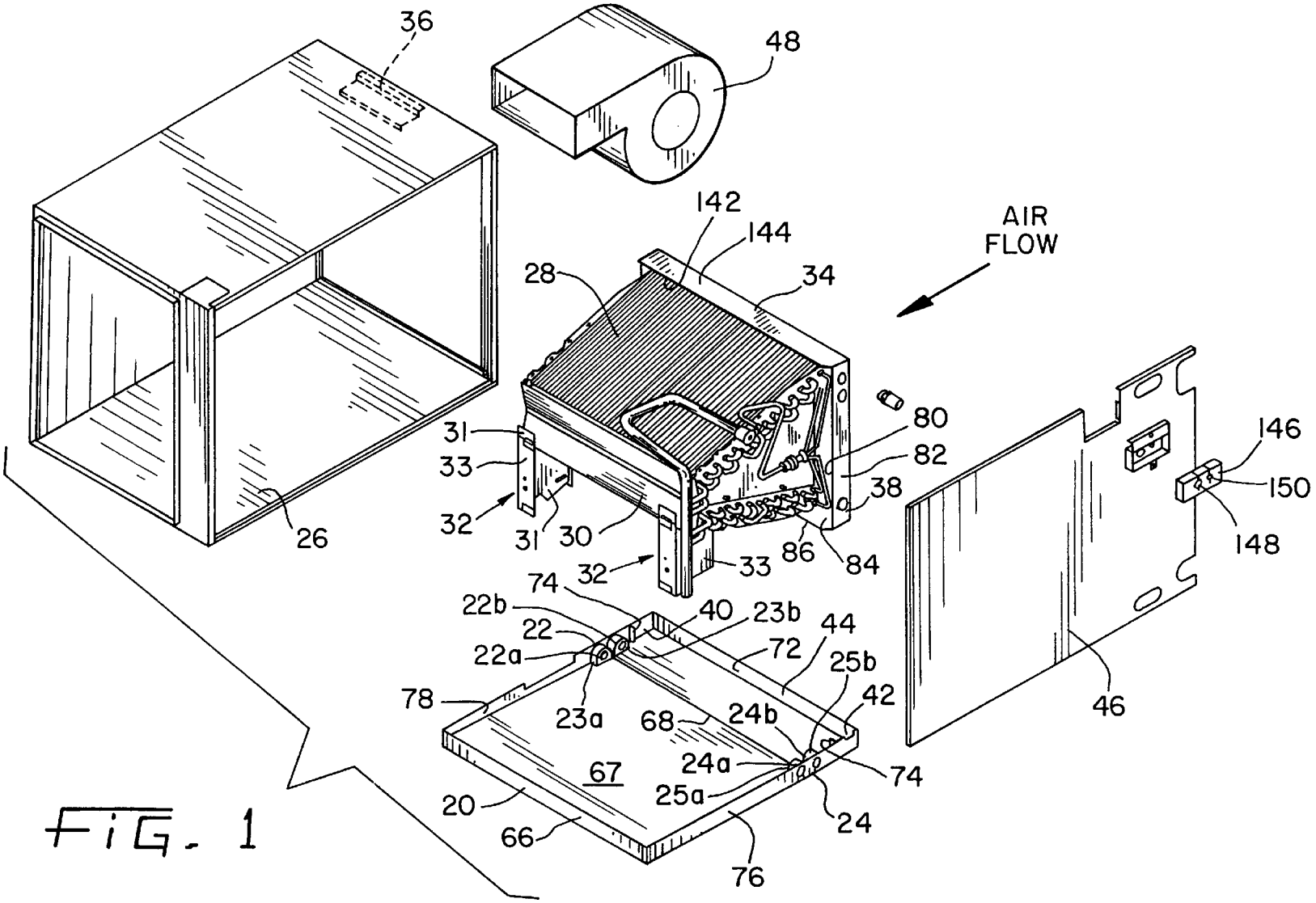
FIG. 1 is an exploded view of an evaporator coil section of a refrigeration system illustrating the improved drainage management system of the present invention.

Corresponding reference characters indicate corresponding parts throughout the several views of the drawings. The exemplifications set out herein illustrate embodiments of the invention, in several forms, and such exemplifications are not to be construed as limiting the scope of the disclosure or the scope of the invention in any manner.

DESCRIPTION OF THE EXEMPLARY EMBODIMENT

In a typical refrigeration system in which the present invention is used, a compressor (not shown) is operatively connected to an evaporator. An evaporator outlet is connected to the compressor by means of vapor suction line. A condenser (not shown) is connected to the compressor by means of a high pressure line. The condenser feeds refrigerant by means of a conduit to an expansion device (not shown) which in turn is connected to the inlet of the evaporator.

Referring now to FIG. 1, the improved drainage management system of the present invention provides drain pan 20 with two pairs of drain openings 22 and 24 located on opposite sidewalls of the drain pan and having alternative drain openings 22*a*, 22*b*, 24*a*, and 24*a* for receiving primary drainage conduit fittings and removable secondary drain plugs, illustrated in FIGS. 5*a* through 5*d*. In the preferred embodiment, the improved drainage management system is to be used with cased coils such as evaporator coils for air conditioning systems and the like which have their own housings, such as housing 26.

Typically, coil 28 is installed in a duct system (not shown) of a building wherein the coil casing serves as part of the duct system. Moisture present in the air as it passes over coil 28 condenses and is deposited on the coil. The condensate is conducted to drain pan 20, 34, discussed in more detail below, which forms part of the coil casing. Drain pan 20, 34 is typically made from metal, such as steel, or plastic and includes a primary drain hole. The primary drain hole is selected from pairs of openings 22 and 24, 37 and 38 and is connected to a drain conduit to remove the condensate from drain pan 20, 34 to a drain sewer, the outside, etc. A secondary drain hole is selected from one of the remaining openings of pairs 22 and 24 and provides over-flow relief if the primary drain hole becomes obstructed. It is desirable to locate the secondary drain hole in an area where the homeowner can detect whether condensate is draining through the secondary drain hole. If condensate is being drained through the secondary drain hole, then the homeowner is alerted to the fact that the primary drain hole is plugged. The present invention provides an arrangement whereby the secondary drain plugs can be inserted in various locations in the drain pan so the selected location can have optimum visual accessibility.

In accordance with the present invention, any of the drain openings 22*a*, 22*b*, 24*a*, and 24*b* may be connected to the primary drain tube and any of the openings may be connected to a secondary drain tube. The drain openings may be made of plastic, metal, or a combination thereof and are preferably surrounded by collars 23*a*, 23*b*, 25*a*, and 25*b*, which provide additional support with the openings connected to drain conduits. The remaining openings are normally plugged. As opposed to prior art drain pans that have a dedicated secondary drain opening, the openings of the present drain pan are available for either primary or secondary drainage.

Attached to coil 28 are horizontal baffle plate 30, which is a combination baffle and drain channel, coil supports 32, which also serve as a drainage channel, and rear base plate 34. In the horizontal coil arrangement of FIG. 1, coil 28 is mounted in drain pan 20 by rear base lower portion 38, which is received along rear wall 44 and held in place by slots 40 and 42. Coil 28 is further supported by coil supports 32 and is supported in coil housing 26 by coil hold down bracket 36, which is mounted to the inside upper surface of the housing. With the coil and drain pan assembly mounted inside housing 26, side cover 46 is attached to the housing.

The assembled coil section is typically received in a central air conditioning system (not shown) adjacent, or at least in line with, blower 48 or other suitable device for moving air through coil 28. Air is drawn in from a space and forced through the air conditioning system by blower 48. After being forced through the finned tube sections of coil 28, which are generally constructed from a series of flat, thin plates with refrigerant tubing passing therethrough, the conditioned air exits coil housing 26 and eventually is returned to the space being conditioned. The refrigerant tubing is connected to a compressor in a conventional manner.

Figure 2A:
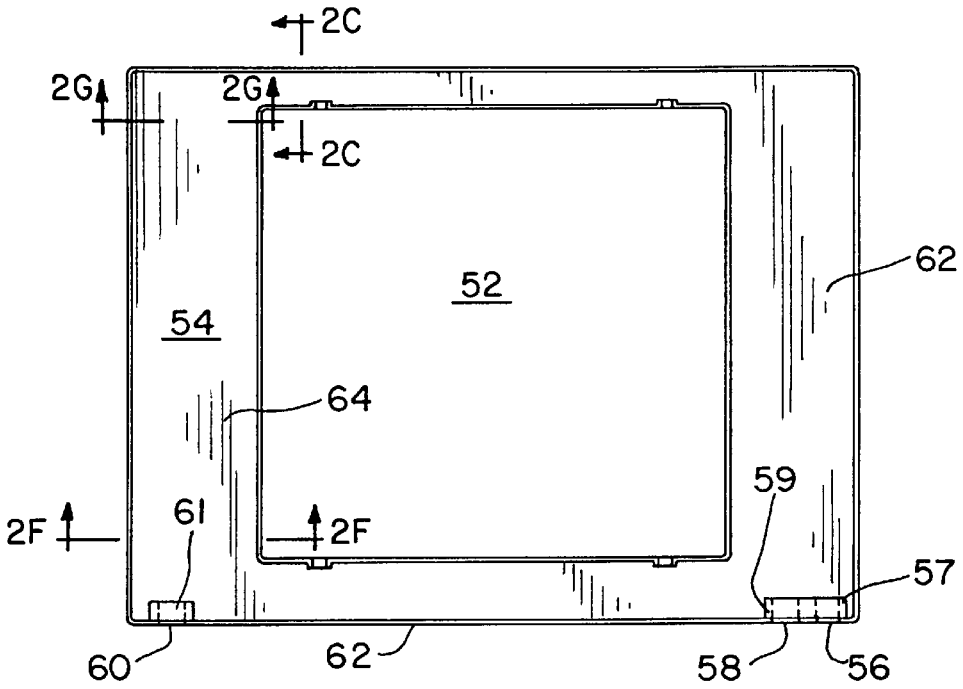
FIG. 2*a* is a top view of a drain pan for use with a vertical coil arrangement in the improved drainage management system of FIG. 1.
Figure 2B:
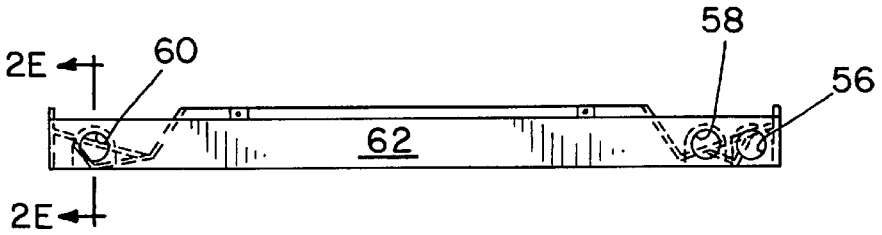
FIG. 2*b* is a front view of the drain pan of FIG. 2*a;*
Figure 2C:
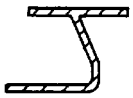
FIG. 2*c* is a sectional view of the drain pan of FIG. 2*a* taken along detail C—C.
Figure 2D:
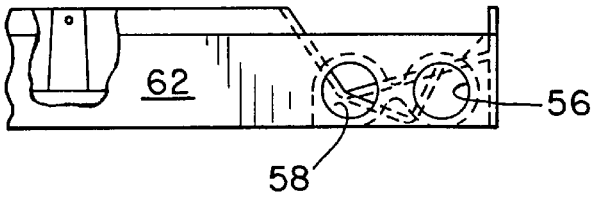
FIG. 2*d* is a partial front view of the drain pan of FIG. 2*a* taken along detail H.
Figure 2E:
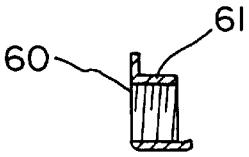
FIG. 2*e* is a sectional view of the drain pan of FIG. 2*b* taken along detail P—P.
Figure 2F:
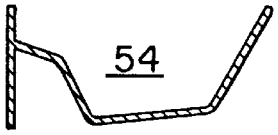
FIG. 2*f* is a sectional view of the drain pan of FIG. 2*a* taken along detail A—A or H—H.
Figure 2G:
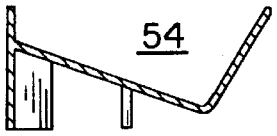
FIG. 2*g* is a sectional view of the drain pan of FIG. 2*a* taken along detail D—D or J—J.
Figure 3A:
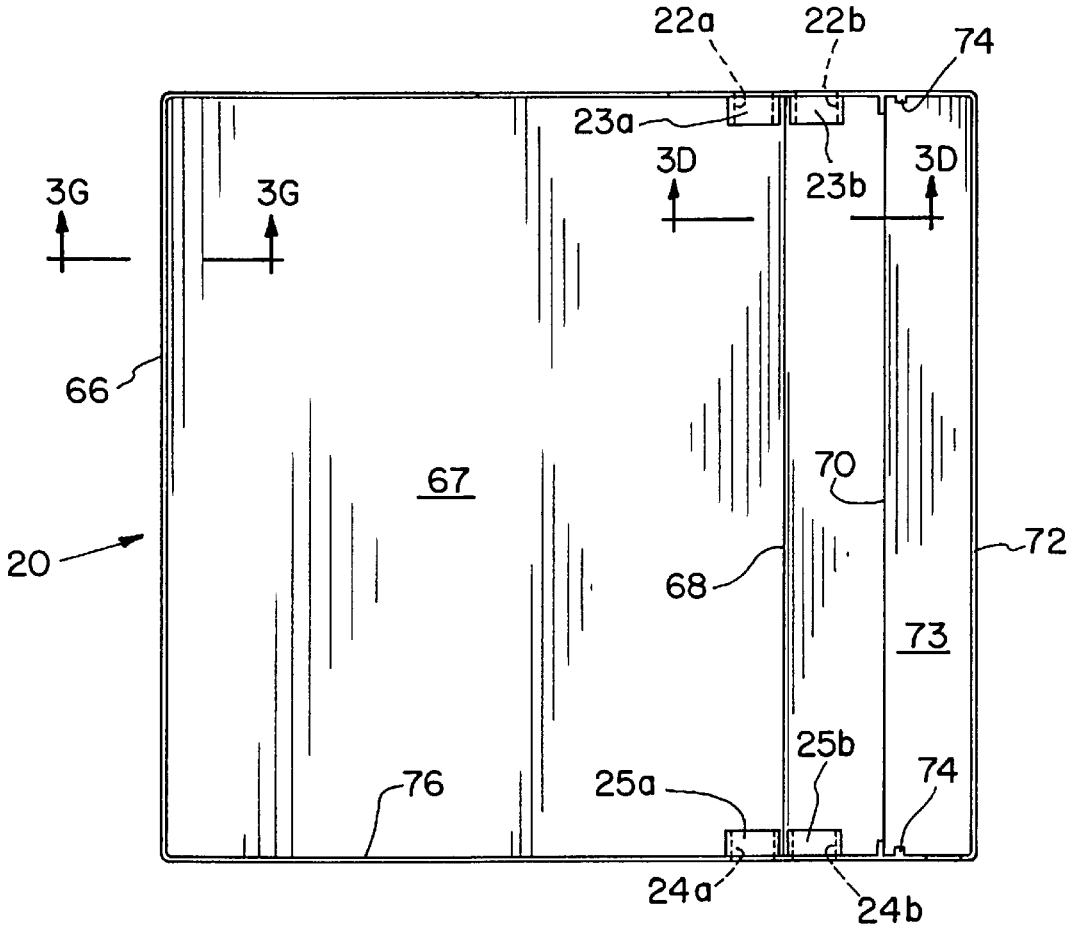
FIG. 3*a* is a top view of a drain pan for use with a horizontal coil arrangement in the improved drainage management system of FIG. 1.
Figure 3B:
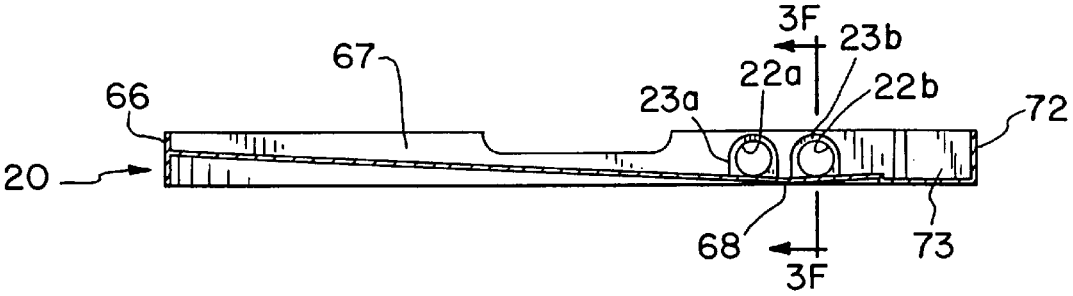
FIG. 3*b* is a front view of the drain pan of FIG. 3*a;*
Figure 3C:
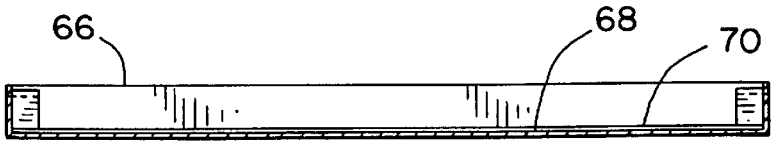
FIG. 3*c* is a rear view of the drain pan of FIG. 3*a;*
Figure 3D:
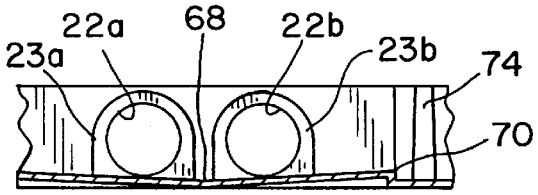
FIG. 3*d* is a partial front view of the drain pan of FIG. 3*a* taken along detail Y—Y.
Figure 3E:
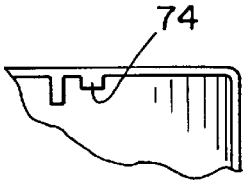
FIG. 3*e* is a partial top view of the drain pan of FIG. 3*a* taken along detail W.
Figure 3F:
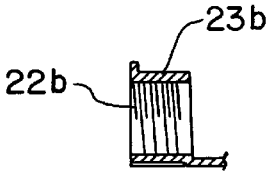
FIG. 3*f* is a sectional view of the drain pan of FIG. 3*b* taken along detail X—X.
Figure 3G:
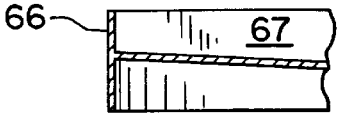
FIG. 3*g* is a partial sectional view of the drain pan of FIG. 3*a* taken along detail Z—Z.

FIGS. 2*a* through 2*g* illustrate an alternative embodiment of the drain pan of the present invention for use with a vertical type A-coil. Drain pan 50 is generally square or rectangular in shape and defines open area 52 which is surrounded by drain channel 54. Three drain openings 56, 58, and 60 are provided along front wall 62 of drain pan 50 and may be connected to a primary condensate drainage conduit, a secondary condensate drainage conduit, or plugged. FIGS. 2*f* and 2*g* depict cross-sections of drain channel 54, as can be seen, the floor of the channel is angled to direct the collected condensate toward a low point in the channel in order to conduct the condensate to the drain openings in a most effective manner. The walls of the drain channel along drain sub-channels 62 and 64 may be angled to mate with the inner lower walls of the vertical A-coil. Sub-channels 62 and 64 may be sloped from back to front to more efficiently direct condensate toward the drain openings in the front of the drain pan. Openings 56, 58, and 60 may be made of plastic, metal, or a combination thereof and are preferably surrounded by collars 57, 59, and 61, which provide additional support with the openings connected to drain conduits.

FIGS. 3*a* through 3*g* illustrate drain pan 20 of FIG. 1 in greater detail, wherein walls 66, 72, 76, and 78 define condensate collection area 67. The drain pan slopes downwardly from left sidewall 66 to drainage channel 68 and slopes upwardly from channel 68 to upraised edge 70. The area in the drain pan from upraised edge 70 to right sidewall 72 defines support channel 73 for receiving rear base lower portion 38 of the A-coil frame. Coil frame support tabs 74 inwardly extend from the inner front and rear walls, 76 and 78 respectively, of drain pan 20 and engage edge 80 of vertical wall 82 of coil rear base 34, thereby providing support for the A-coil when mounted in the horizontal position. Lower horizontal wall 84 inwardly and angularly extends from edge 80 and terminates into edge 86, which, with coil 28 mounted in drain pan 20, engages upraised edge 70. This combination of upraised edge 70, tabs 74, support channel 73, and associated structure of coil rear base 34 provide support for the coil and frame assembly and help hold same in place within the drain pan.

Figure 4A:
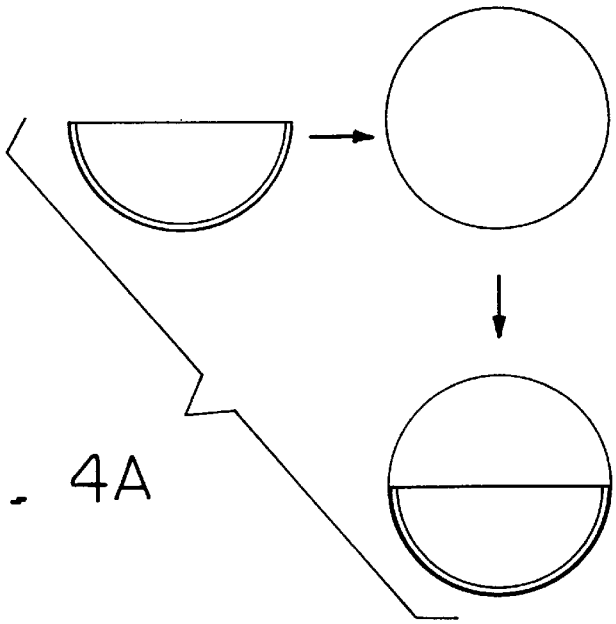
FIG. 4*a* is a diagrammatic view of the drain pan opening and secondary drain plug used in the improved drainage management system of FIG. 1.
Figure 4B:
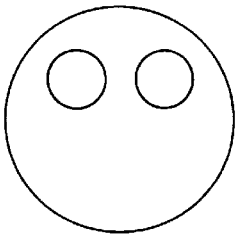
FIG. 4*b* is an alternative diagrammatic view of the drain pan opening and secondary drain plug used in the improved drainage management system of FIG. 1.
Figure 4C:
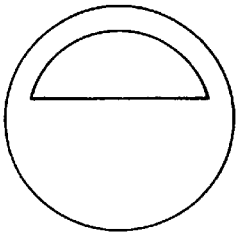
Figure 4D:
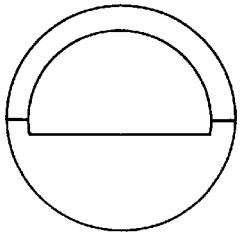
Figure 4E:
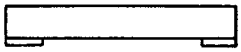
Figure 5A:
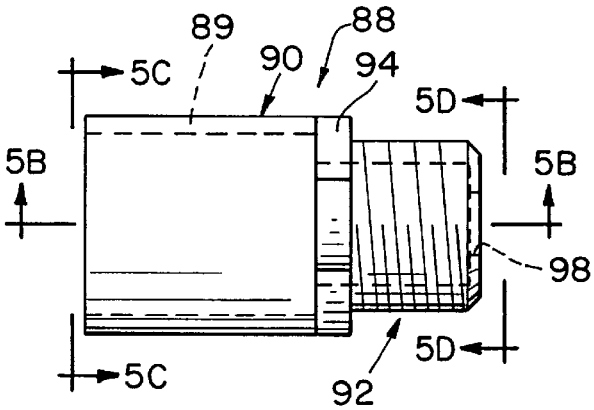
FIG. 5*a* is a side elevational view of the secondary drain plug used in the improved drainage management system of FIG. 1.
Figure 5C:
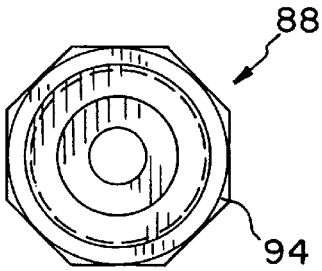
FIG. 5*c* is a top view of the secondary drain plug of FIG. 5*a;*
Figure 5B:
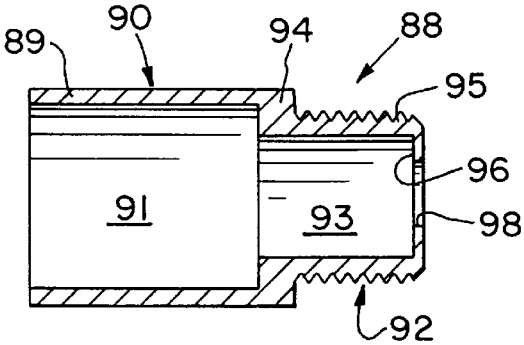
FIG. 5*b* is a cross-sectional view of the secondary drain plug of FIG. 5*a;*
Figure 5D:
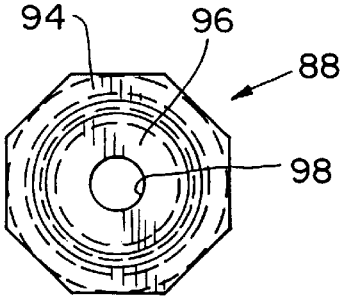
FIG. 5*d* is a bottom view of the secondary drain plug of FIG. 5*a;*

The secondary drain plug of the present invention is illustrated diagrammatically in FIGS. 4*a* and 4*b* and is shown in a particular embodiment in FIGS. 5*a* through 5*d*. Secondary drain plug 88 is shown comprising two sections, conduit connecting section 90, which includes cylindrical wall 89 that defines generally hollow area 91, connects the drain plug to drain tubing (not shown) such as by an adhesive or any other suitable means. Drain pan connecting section 92 includes cylindrical wall 95 that defines generally hollow area 93 and is preferably threaded on its outer surface for being matingly received into a threaded inner surface of any of the drain pan openings. The drain plug may have an octagon or hex shaped portion 94 for conventional mounting. At the bottom of the drain plug, plug wall 96 extends radially inwardly from cylindrical wall 95 and defines small central aperture 98. Small central aperture 98 ensures that the secondary drain connection will only conduct condensate when the condensate reaches a particular level in the drain pan which is higher than the level at which the condensate flows out of the primary drain opening. Plug wall 96 and aperture 98 may have any of a number of shapes provided the end result is that plug 88 will only communicate condensate at a level in the drain pan that is higher than that of safe flow of the primary drain connection.

The multiple openings provided in the drain pan of the present invention are positioned equally on a horizontal plane to permit equally effective drainage regardless of the drainage opening selected. The openings may be connected to either the primary drainage piping or the secondary drainage piping. In one embodiment, multiple openings are located on opposite sides of the drain pan, thereby permitting the unit to be piped so as to provide the greatest access to the end user. The drainage plug effects the conversion of a conventional primary drainage opening into a secondary opening.

As described above, the improved drainage management system of the present invention provides a drainage pan for use in horizontal A-coil applications. The base of the pan is sloped so that liquids collected therein drain toward the two pairs of drainage openings located on opposite sides of the pan. The openings are on an equal horizontal plane for equivalent draining efficiency. Any combination of the openings may be connected to the primary and secondary drainage piping, depending upon accessibility. The horizontal drain pan is provided with a coil support channel for receiving an end of the frame surrounding the A-coil. The pan permits either horizontal left or horizontal right arrangements.

Another aspect of the improved drainage management system of the present invention provide coil support assemblies 32 which are comprised of support members 31 and 33, illustrated in FIGS. 1, 6*a* through 6*c*, 7, and 8*a* through 8*c*, which are sandwiched together to form a combination support member and drain channel. Coil support assemblies 32 are positioned at opposite sides of the front end of horizontal mounted A-coil 28, at points distal rear coil frame 34. Coil supports 32 are configured so that they may be used on either side of the A-coil.

Figure 6A:
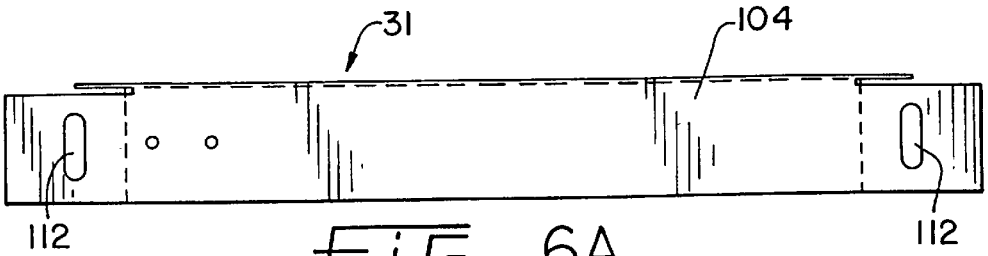
FIG. 6*a* is a front view of the combination coil support and drain channel used in the improved drainage management system of FIG. 1.
Figure 6B:
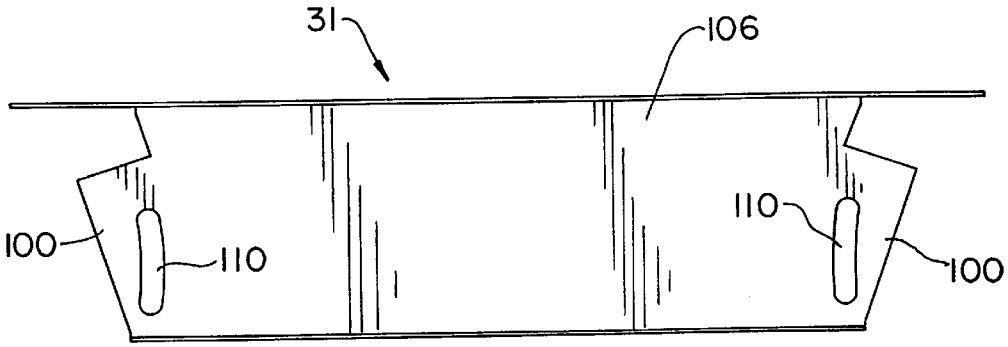
FIG. 6*b* is a side view of the combination coil support and drain channel of FIG. 6*a;*
Figure 6C:
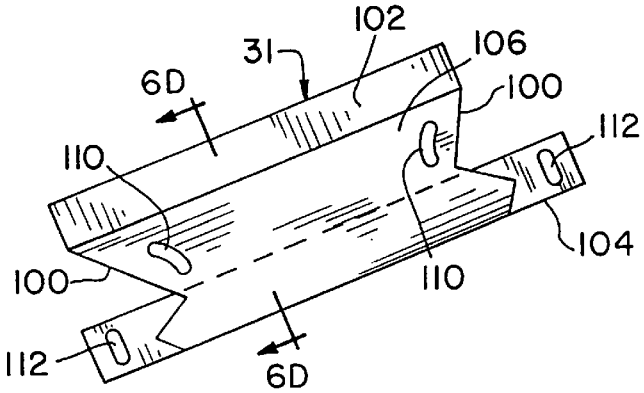
FIG. 6*c* is a sectional view of the combination coil support and drain channel taken along lines 6*c;*
Figure 6D:
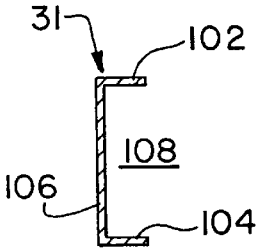
Figure 7:
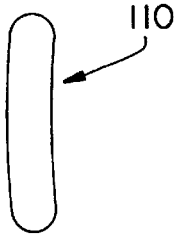
FIG. 7 is a detail view of a slot provided in the combination coil support and drain channel of FIG. 6*a;*
Figure 8A:
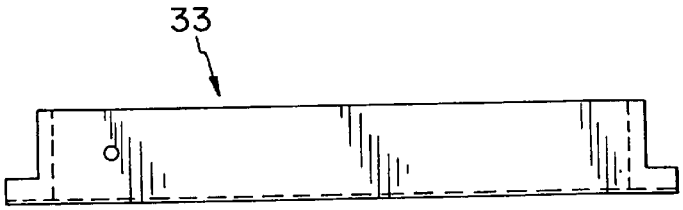
FIG. 8*a* is a front view of a second member of the combination coil support and drain channel assembly used in the improved drainage management system of FIG. 1.
Figure 8B:
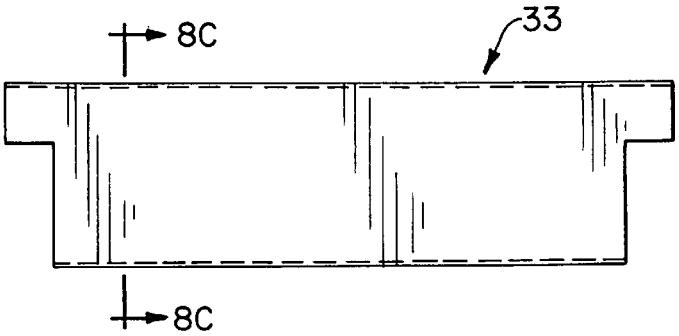
FIG. 8*b* is a side view of the second member of the combination coil support and drain channel of FIG. 8*a;*
Figure 8C:
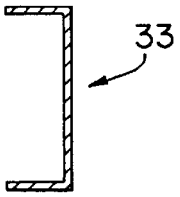
FIG. 8*c* is a sectional view of the second member of the combination coil support and drain channel taken along lines 8*c;*
Figure 8D:
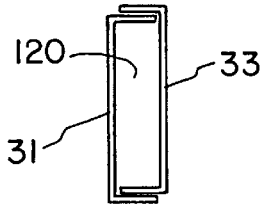
FIG. 8*d* is a sectional view of the combination coil support and drain channel.

Coil support member or plate 31, shown in FIGS. 6*a* through 6*c*, includes angled support portions 100 which are configured to mate with the angled frame of the finned tube sections of coil 28. Upper, lower, and intermediate walls 102, 104, and 106, respectively, of coil support member 31 provide a generally U-shaped cross-section, as shown in FIG. 6*c*. Slots 110 and 112 are provided for attaching coil support assemblies 32 to various components of the coil assembly, such as baffle plate 30. Coil support member 33, shown in FIGS. 8*a* through 8*c*, includes upper, lower, and intermediate walls 114, 116, and 118, respectively, which provide a generally U-shaped cross-section, as shown in FIG. 8*c*. The U-shaped channels formed by support members 31 and 33 provide enclosed drainage channel 120, as shown in cross-section in FIG. 8*d*, to conduct condensate from the coil and baffle to the drain pan. Support member 31 and 32 are attached to one another such as by screws or any other suitable means.

Figure 9A:
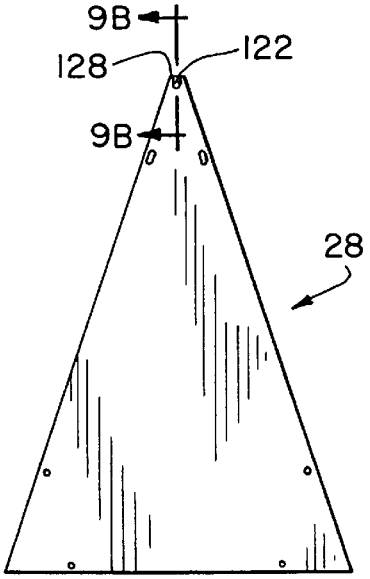
FIG. 9*a* is a side view of the A-type evaporator coil used in the improved drainage management system of FIG. 1.
Figure 9B:
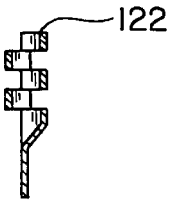
FIG. 9*b* is a partial sectional view of the apex of the A-coil of FIG. 9*a* illustrating an opening for receiving a screw for attaching the combination coil baffle and drainage channel used in the improved drainage management system of FIG. 1.
Figure 10A:
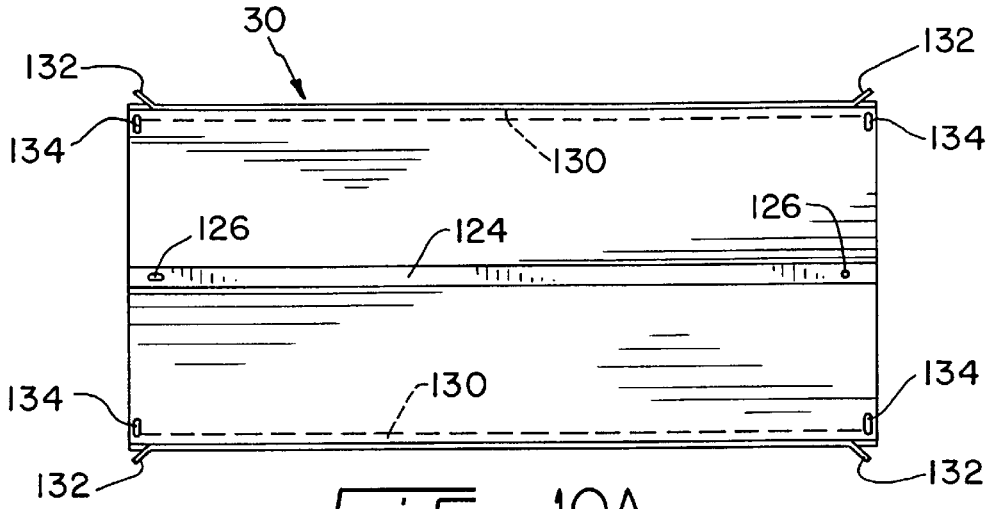
FIG. 10*a* is front view of the combination coil baffle and drainage channel for use with the horizontal A-coil arrangement of the improved drainage management system of FIG. 1.
Figure 10B:
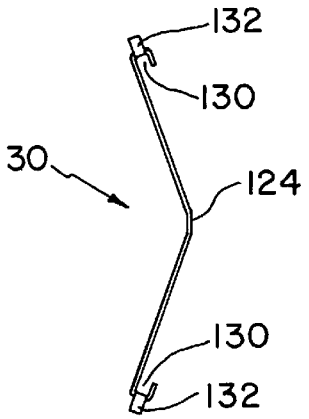
FIG. 10*b* is side view of the combination coil baffle and drainage channel of FIG. 10*a;*
Figure 10C:
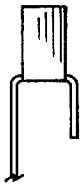
FIG. 10*c* is partial side view of the combination coil baffle and drainage channel of FIG. 10*b* detailing the drainage channel and the drainage directing tab.
Figure 10D:
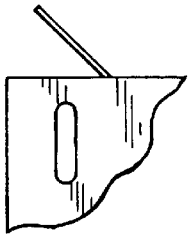
FIG. 10*d* is partial top view of the combination coil baffle and drainage channel of FIG. 10*a* detailing the drainage directing tab and a slot for attaching the coil baffle to the A-coil.
Figure 10E:
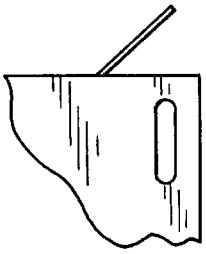
FIG. 10*e* is partial top view of the combination coil baffle and drainage channel of FIG. 10*a* detailing the drainage directing tab and a slot for attaching the coil baffle to the A-coil.

Another aspect of the improved drainage management system of the present invention provides baffle plate 30, illustrated in FIGS. 1, 10*a* through 10*e*, and 11*a* through 11*b*. The baffle is attached to the A-coil along ridge 124 at openings 126 by screws or the like, which are received in openings 122 of coil 28, as shown in FIGS. 9*a* and 9*b*. Baffle plate 30 is positioned along top surface 128 of A-coil 28 and has a V-shaped cross-section, as shown in FIG. 10*b*. U-shaped drainage channels 130 extend lengthwise along opposite sides of baffle plate 30 and collect condensate from A-coil 28. During compressor operation, liquid condenses on the finned tube sections of the A-coil. In prior art coil sections, on-rushing air picks up much of the condensed moisture and carries it off into the HVAC ductwork before the moisture can be collected and carried off via the drainage system, this is referred to as "blow-off." The baffle plate and coil support arrangement of the present invention alleviates this problem by effectively collecting the condensate and conducting it to the drain pan before it is "blown off" by the on-rushing air. In fact, the on-rushing air directs the condensate toward baffle plate 30 and forces it along the drain channels 130 and 120 to drain pan 20.

Figure 11B:
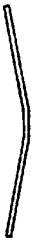
FIG. 11*b* is side view of the coil baffle plate of FIG. 11*a;*
Figure 11A:
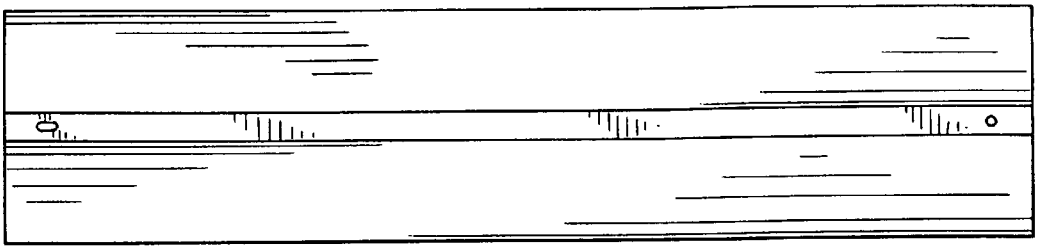
FIG. 11*a* is front view of the coil baffle plate for use with a vertical A-coil arrangement used in the improved drainage management system of the present invention.

With the baffle plate and the supports in place, the condensed liquid collects in U-shaped channels 130 of the baffle plate and is carried off to the sides of the A-coil and away from the middle of the drain pan. Support channels 120 are in fluid communication with baffle channels 130, whereby the collected fluid is communicated into the support channels. Directional tabs 132 help funnel the collected condensate into channels 120, which act like downspouts depositing the condensate into the drain pan along either side of the A-coil. Attachment slots 134 provide greater tolerances for other parts of the coil assembly. The lance design allows pieces to be attached without compromising the properties of the improved drainage management system. FIGS. 11*a* and 11*b* illustrate an alternate baffle plate for use with A-coils in air-conditioning or refrigeration systems.

Figure 12A:
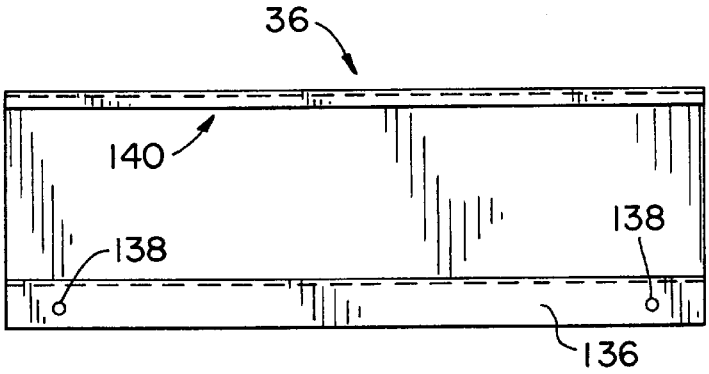
FIG. 12*a* is front view of a coil hold down bracket for use in the horizontal A-coil arrangement of the improved drainage management system of FIG. 1.
Figure 12B:
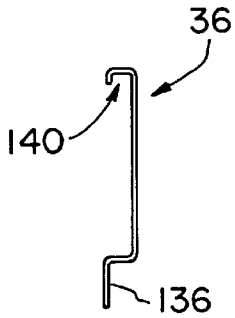
FIG. 12*b* is side view of the coil hold down bracket of FIG. 12*a;*

FIGS. 12*a* and 12*b* illustrate coil hold down bracket 36 which is attached to the inner surface of the top horizontal wall of coil housing 26 along flange portion 136 at openings 138 by screws or the like, or may be attached by welding or the like. Coil bracket 36 helps hold evaporator coil 28 in place both during shipping and in horizontal coil mounting applications. Looped portion 140 provides a hook-like catch along the length of bracket 36 which receives and engages edge 142 of upper wall 144 of rear base plate 34, thereby maintaining the coil in a horizontal orientation and preventing the coil assembly from moving in the forward direction away from the rear wall of the coil housing.

Figure 13A:
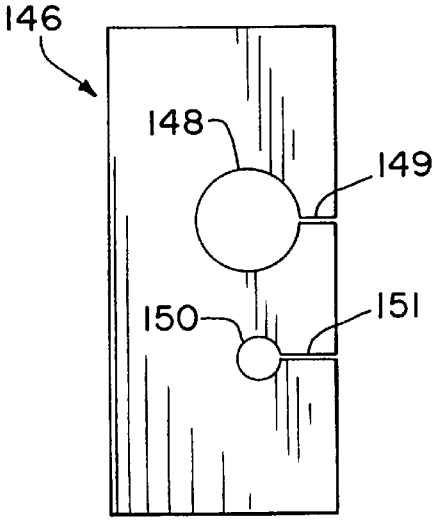
FIG. 13*a* is front view of a turbo plate grommet for use in the horizontal A-coil arrangement of the improved drainage management system of FIG. 1.
Figure 13B:
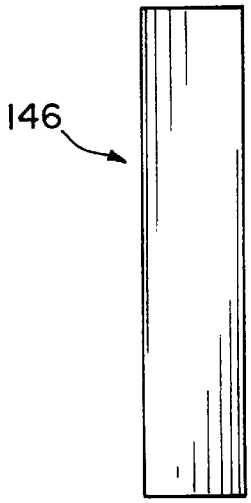
FIG. 13*b* is bottom view of the turbo plate grommet of FIG. 13*a*.

FIGS. 13*a* and 13*b* illustrate grommet 146 for use with tubing plate cover 46 to provide an air-tight seal around the refrigerant lines (not shown) after the brazing operation has been completed. This replaces individual round rubber grommets formerly used. Refrigerant lines are received in and through openings 148 and 150. Relief splits 149 and 151 are provided for ease in installation.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A drain pan for a heat exchanger in an air conditioning or refrigeration system comprising:

a base portion having a sloped region and a channel, said channel defining a low point of said base portion; and a plurality of walls extending from said base portion, said plurality of walls including a first wall adjacent said channel and having first and second ports, said plurality of walls including a second wall adjacent said channel and having third and fourth ports whereby condensate from the heat exchanger which falls on said base portion may be drained through one of said first port and said third port;

and a secondary drain plug structured and arranged to be located in one of said first, second, third and fourth ports to provide a second drainage path higher than the other of said first and third ports.

2. The drain pan of claim 1 wherein one of said first and second ports includes internal threading and said secondary drain plug includes external threading for engaging said internal threading of said one of said first and second ports.

3. An air conditioning or refrigeration unit associated with air handling equipment, said unit comprising:

a support structure;

a heat exchanger, said heat exchanger mounted in said support structure; and a drain pan disposed beneath said heat exchanger in said support structure, said drain pan including a base portion having a sloped region and a channel, said channel defining a low point of said base portion, said drain pan further including a plurality of walls extending from said base portion, said plurality of walls including a first wall adjacent said channel and having a first port, said plurality of walls including a second wall adjacent said channel and have a second port whereby condensate from said heat exchanger which falls on said base portion may be drained through either said first port or said second port; and a secondary drain plug structured and arranged to be located in one of said first and second ports to provide a second drainage path higher than the other of said first and second ports.

4. The air conditioning or refrigeration unit of claim 3 wherein one of said first and second ports includes internal threading and said secondary drain plug includes external threading for engaging said internal threading of said one of said first and second ports.

5. An air conditioning or refrigeration system comprising:

a compressor;

first and second heat exchangers coupled with said compressor; and a support structure for supporting one said first and second heat exchangers, and a drain pan disposed beneath said one of said first and second heat exchangers, said drain pan disposed in said support structure, said drain pan including a base portion having a sloped region and a channel, said channel defining a low point of said base portion, said drain pan further including a plurality of walls extending from said base portion, said plurality of walls including a first wall adjacent said channel and having a first port, said plurality of walls including a second wall adjacent said channel and having a second port whereby condensate from said one of said first and second heat exchangers which falls on said base portion may be drained through either said first port or said second port, and a secondary drain plug structured and arranged to be located in one of said first and second ports to provide a second drainage path higher than the other of said first and second ports.

6. The air conditioning or refrigeration system of claim 5 wherein one of said first and second ports includes internal threading and said secondary drain plug includes external threading for engaging said internal threading of said one of said first and second ports.

7. A support assembly for a heat exchanger in an air conditioning or refrigeration system comprising:

a drain pan having a sloped region and a channel, said channel being in fluid communication with a drainage system;

a plate disposed on said drain pan; and a baffle supported by said plate for supporting the coils of the heat exchanger;

said baffle including a surface abutting a portion of said plate, said plate including a passageway for directing flow of condensate from the coils to said plate and to said drain pan whereby condensate which forms on the heat exchanger is effectively removed from the heat exchanger to said drain pan.

8. The support assembly of claim 7 wherein said drain pan includes a brace for receiving and supporting a portion of the heat exchanger.

9. The support assembly of claim 7 wherein said plate includes a tab and said baffle includes an aperture, said tab extending through said aperture whereby said plate supports said baffle and condensate is drawn by capillary attraction from said baffle to said plate.

10. The support assembly of claim 7 wherein said baffle includes a condensate drainage channel in fluid communication with said plate passageway.

11. The support assembly of claim 10 wherein said baffle includes at least one tab at an end of said drainage channel adjacent said plate passageway.

12. An air conditioning or refrigeration unit associated with air handling equipment, said unit comprising:

a support structure;

a heat exchanger mounted in said support structure;

a drain pan having a sloped region and a channel, said channel being in fluid communication with a drainage system;

a plate disposed on said drain pan; and a baffle supported by said plate for supporting the coils of the heat exchanger;

said baffle including a surface abutting a portion of said plate, said plate including a passageway for directing flow of condensate from the coils to said plate and to said drain pan whereby condensate which forms on said heat exchanger is effectively removed from the heat exchanger to said drain pan.

13. The air conditioning or refrigeration unit of claim 12 wherein said drain pan includes a brace for receiving and supporting a portion of said heat exchanger.

14. The air conditioning or refrigeration unit of claim 12 wherein said plate includes a tab and said baffle includes an aperture, said tab extending through said aperture whereby said plate and baffle are connected and condensate in drawn by capillary attraction from said baffle to said plate.

15. The air conditioning or refrigeration unit of claim 12 wherein said baffle includes a condensate drainage channel in fluid communication with said plate passageway.

16. The air conditioning or refrigeration unit of claim 15 wherein said baffle includes at least one tab at an end of said drainage channel adjacent said plate passageway.

17. An air conditioning or refrigeration system comprising:

a compressor;

first and second heat exchangers coupled with said compressor; and a heat exchange unit including a support structure, one of said first and second heat exchangers mounted in said support structure, said heat exchange unit further including a drain pan having an sloped region and a channel, said channel being in fluid communication with a drainage system, a plate disposed on said drain pan, and a baffle supported by said plate for supporting the coils of said heat exchangers, said baffle including a surface abutting a portion of said plate, said plate including a passageway for directing flow of condensate from the coils to said plate and to said drain pan whereby condensate which forms on said heat exchangers is effectively removed from said heat exchangers to said drain pan.

18. The air conditioning or refrigeration system of claim 17 wherein said drain pan includes a brace for receiving and supporting a portion of said heat exchanger of said heat exchange unit.

19. The air conditioning or refrigeration system of claim 17 wherein said plate includes a tab and said baffle includes an aperture, said tab extending through said aperture whereby said plate and baffle are connected and condensate in drawn by capillary attraction from said baffle to said plate.

20. The air conditioning or refrigeration system of claim 17 wherein said baffle includes a condensate drainage channel in fluid communication with said plate passageway.

21. The air conditioning or refrigeration system of claim 20 wherein said baffle includes at least one tab at an end of said drainage channel adjacent said plate passageway.

* * * * *